US009506360B2

(12) United States Patent
Wunderer

(10) Patent No.: US 9,506,360 B2
(45) Date of Patent: Nov. 29, 2016

(54) CONTINUOUS-FLOW MACHINE WITH AT LEAST ONE GUIDE VANE RING

(71) Applicant: MTU Aero Engines AG, Munich (DE)

(72) Inventor: Roland Wunderer, Unterschleissheim (DE)

(73) Assignee: MTU Aero Engines AG, Munich (DE)

( * ) Notice: Subject to any disclaimer, the term of this patent is extended or adjusted under 35 U.S.C. 154(b) by 676 days.

(21) Appl. No.: 13/960,943

(22) Filed: Aug. 7, 2013

(65) Prior Publication Data

US 2014/0044518 A1 Feb. 13, 2014

(30) Foreign Application Priority Data

Aug. 9, 2012 (EP) ..... 12179779

(51) Int. Cl.

| | |
|---|---|
| ***F01D 9/04*** | (2006.01) |
| ***F01D 5/14*** | (2006.01) |
| ***F01D 17/16*** | (2006.01) |
| ***F04D 29/54*** | (2006.01) |
| ***F04D 29/56*** | (2006.01) |

(52) U.S. Cl.

CPC ..... *F01D 9/04* (2013.01); *F01D 5/141* (2013.01); *F01D 5/146* (2013.01); *F01D 9/041* (2013.01); *F01D 17/162* (2013.01); *F04D 29/544* (2013.01); *F04D 29/563* (2013.01); *F05D 2240/121* (2013.01); *F05D 2240/122* (2013.01); *F05D 2270/10* (2013.01); *F05D 2270/102* (2013.01)

(58) Field of Classification Search

CPC ..... F01D 9/04; F01D 5/14; F01D 5/12; F04D 29/68; F04D 29/32

USPC ..... 415/193–195, 162, 149.4

See application file for complete search history.

(56) References Cited

U.S. PATENT DOCUMENTS

| | | | | |
|---|---|---|---|---|
| 2,029,813 | A * | 2/1936 | De Mey | F04D 29/544 415/119 |
| 4,013,378 | A * | 3/1977 | Herzog | F01D 25/30 415/208.2 |
| 4,995,786 | A | 2/1991 | Wheeler et al. | |
| 6,328,533 | B1 * | 12/2001 | Decker | F01D 5/141 416/223 A |
| 6,375,419 | B1 * | 4/2002 | LeJambre | F01D 5/141 415/191 |
| 6,508,630 | B2 * | 1/2003 | Liu | F01D 5/145 416/228 |
| 6,554,564 | B1 | 4/2003 | Lord | |
| 6,905,307 | B2 | 6/2005 | Kawarada et al. | |

(Continued)

FOREIGN PATENT DOCUMENTS

| | | | | |
|---|---|---|---|---|
| DE | EP 0043452 A2 * | 1/1982 | | F01D 5/146 |
| DE | 10 2009 023 100 | 12/2010 | | |

(Continued)

*Primary Examiner* — Thai Ba Trieu
*Assistant Examiner* — Shafiq Mian
(74) *Attorney, Agent, or Firm* — Davidson, Davidson & Kappel, LLC

(57) ABSTRACT

A continuous-flow machine, especially an axial compressor, having at least one guide vane ring that includes at least one row of adjustable guide vanes, whereby each guide vane is tapered relative to its vane body in the direction of its longitudinal axis as seen in a side view of the guide vane. In order to increase the stability of the flow in the continuous-flow machine, each row of guide vanes comprises first guide vanes and second guide vanes, whereby, as seen in a combined side view of a first guide vane and of a second guide vane, each first guide vane is tapered along its vane body in the lengthwise direction, and each second guide vane is tapered in the opposite direction.

19 Claims, 6 Drawing Sheets

(56) References Cited

U.S. PATENT DOCUMENTS

| | | | | |
|---|---|---|---|---|
| 8,403,629 | B2 * | 3/2013 | Lundbladh | F01D 25/162 415/115 |
| 8,974,175 | B2 | 3/2015 | Domercq et al. | |
| 2002/0141863 | A1 * | 10/2002 | Liu | F01D 5/145 415/192 |
| 2005/0175448 | A1 * | 8/2005 | Jacobsson | F04D 19/02 415/194 |
| 2010/0111683 | A1 * | 5/2010 | Konter | F01D 5/142 415/191 |
| 2010/0158685 | A1 * | 6/2010 | Lebrun | F01D 9/042 415/209.3 |
| 2010/0284801 | A1 * | 11/2010 | Greim | F01D 5/141 415/182.1 |
| 2010/0303629 | A1 * | 12/2010 | Guemmer | F01D 5/146 416/223 R |

FOREIGN PATENT DOCUMENTS

| | | |
|---|---|---|
| EP | 0745755 | 12/1996 |
| EP | 1998006 | 12/2008 |
| JP | 2003056304 | 2/2003 |
| WO | WO 2007/042522 | 4/2007 |
| WO | WO2010007224 | 1/2010 |

* cited by examiner

CONTINUOUS-FLOW MACHINE WITH AT LEAST ONE GUIDE VANE RING

This claims the benefit of European Patent Application EP 121 797 79.9, filed Aug. 9, 2012, and hereby incorporated by references herein.

The invention relates to a continuous-flow machine, especially an axial compressor, with at least one guide vane ring, and it also relates to a method for increasing the stability of the flow in a continuous-flow machine.

BACKGROUND

Continuous-flow machines often have adjustable guide vanes, especially in the front stages of compressors. Depending on the operating state of the continuous-flow machine, they are used to adjust the inflow angles to the runner blades downstream and to regulate the energy conversion of the stage consisting of the guide vanes and the runner blades. When the guide vanes are adjusted, the flow angle changes over the entire height of the channel. When the operating state changes, however, the distribution of the local mass flow along the height of the channel changes. This can diminish the stability of the flow in the continuous-flow machine and reduce the efficiency.

Various measures are known for increasing the stability of the flow in a continuous-flow machine. For example, European patent application EP 0 745 755 A1 describes a specially shaped guide vane for a compressor of a gas turbine. The guide vane has a rear edge that is angled towards the blade root. The use of such guide vanes improves the stability of the flow and thus increases the compressor pump limit. A drawback here is that the geometry of the guide vanes is adapted to a specific operating state and, if a deviation from the operating state occurs, an improved flow is no longer ensured.

German patent application DE 10 2009 023 100 A1 describes a blade device with blades arranged one after the other in the flow direction, whereby the rear edges of the upstream blades are shaped differently from the front edges of the downstream blades, resulting in an irregular distance along the blade edges. This arrangement is also aimed at stabilizing the flow in the continuous-flow machine. This arrangement likewise has the drawback that the geometry of the blades is adapted to a specific operating state.

International patent application WO 2007/042522 A1 describes a blade for a turbo machine in which the chord length along the blade length is irregular. This blade minimizes losses of a blade cascade and is likewise designed for a specific operating range.

SUMMARY OF THE INVENTION

It is an object of the present invention to provide a continuous-flow machine with which the stability of the flow is improved and the operating range is expanded.

The present invention provides a continuous-flow machine, especially an axial compressor, with at least one guide vane ring that comprises at least one row of adjustable guide vanes, whereby each guide vane is tapered relative to its vane body in the direction of its longitudinal axis as seen in a side view of the guide vane. Each row of guide vanes comprises first guide vanes and second guide vanes, whereby, as seen in a combined side view of a first guide vane and of a second guide vane, each first guide vane is tapered along its vane body in the lengthwise direction, and each second guide vane is tapered in the opposite direction.

The combined side view arises from lining up a loose first guide vane and a loose second guide vane. The combined side view is not the view of a first guide vane and of a second guide vane in their installed position.

The tapering of each guide vane relates to the associated vane body or blade. The tapering of the guide vanes in opposite directions causes the flow to be deflected more strongly in the non-tapered sections than in the tapered sections. As a result, the flow is stabilized. A preferred area of application comprises axial compressors.

In a special embodiment of the invention, at least one first guide vane and at least one second guide vane, preferably a total of two or three guide vanes, form a unit, and a plurality of these units is evenly distributed in the circumferential direction of the guide vane ring, whereby the distances between adjacent guide vanes are different from each other or equal to each other.

Different ways of grouping the first and second guide vanes can create different, evenly distributed or regularly bundled flow paths.

In another possible embodiment, the second guide vanes—as compared to the first guide vanes of the same row—are in the same position in the axial direction of the continuous-flow machine or else are arranged offset with respect to each other. When they are in the same position, the result is a compact design. An offset arrangement can lengthen the flow path in the axial direction of the continuous-flow machine.

Moreover, in the combined side view, the first guide vanes and the second guide vanes can have an overlapping area, whereby the overlapping area has a straight, slanted or curved configuration in the axial direction of the continuous-flow machine. The overlapping area allows a smooth transition between the inner and outer flow paths in the channels between two adjacent guide vanes in the radial direction of the continuous-flow machine.

In addition, the overlapping area can be located in an area of 30% to 70% of a channel height that is defined by the length of the vane body of each first guide vane and of each second guide vane. The best results are achieved with such an area.

In a first embodiment, the tapering of each first guide vane is formed on the rear edge of the appertaining first guide vane, and the tapering of each second guide vane is formed on the rear edge of the appertaining second guide vane.

In a second embodiment, the tapering of each first guide vane is formed on the front edge of the appertaining first guide vane, and the tapering of each second guide vane is formed on the front edge of the appertaining second guide vane.

In a third embodiment, the tapering of each first guide vane is formed on the rear edge of the appertaining first guide vane, and the tapering of each second guide vane is formed on the front edge of the appertaining second guide vane.

In a fourth embodiment, the tapering of each first guide vane is formed on the rear edge and on the front edge of the appertaining first guide vane, and the tapering of each second guide vane is likewise formed on the rear edge and on the front edge of the appertaining second guide vane.

These four different embodiments make it possible to obtain different channel lengths and channel courses between two adjacent guide vanes.

In particular, the tapering can be configured by a simple or double curvature, or else the tapering can be configured by a stepped contour having at least two stepped transitions, whereby each stepped transition is angular or rounded off. A curvature allows a smooth deflection of the flow, whereas a stepped contour is easier to produce.

In particular, the tapering of each first guide vane can amount to 30% to 70% of the maximum width of each second guide vane, or else the tapering of each second guide vane can amount to 30% to 70% of the maximum width of each first guide vane. The best results are achieved with such an area.

Moreover, the first guide vanes and the second guide vanes that are each in the same position along the longitudinal axis can have different curvatures of their blade skeleton lines and/or different profile mean lines. This permits a further, more detailed adaptation of the channels to the local flow.

In particular, the first guide vanes and the second guide vanes can each have different curvatures of the skeleton lines and/or different profile mean lines in an outer area and in an inner area in the radial direction of the continuous-flow machine.

As a result, an even more specific adaptation to the local flow in the channels is possible. The overlapping area ensures a smooth transition between the inner areas and the outer areas in the radial direction of the continuous-flow machine.

In another embodiment, the first guide vanes and the second guide vanes can each rotate around their longitudinal axes, whereby the first guide vanes and the second guide vanes are coupled or else can be rotated independently of each other. In this manner, the guide vane cascade can be adapted to the operating state. The separate adjustment of the first and second guide vanes allows an even more specific adaptation of the channels.

Moreover, the present invention provides a method for increasing the stability of the flow in a continuous-flow machine. In the radial direction of the continuous-flow machine, each guide vane having an inner tapering deflects the flow to the outside, while each guide vane having an outer tapering deflects the flow to the inside. The increased stability of the flow prevents a compressor pumping effect and permits a wider operating range for the continuous-flow machine.

BRIEF DESCRIPTION OF THE DRAWINGS

A number of embodiments of the invention will be explained in greater detail below with reference to the figures. The following is shown.

DETAILED DESCRIPTION OF THE DRAWINGS

Figure 12:
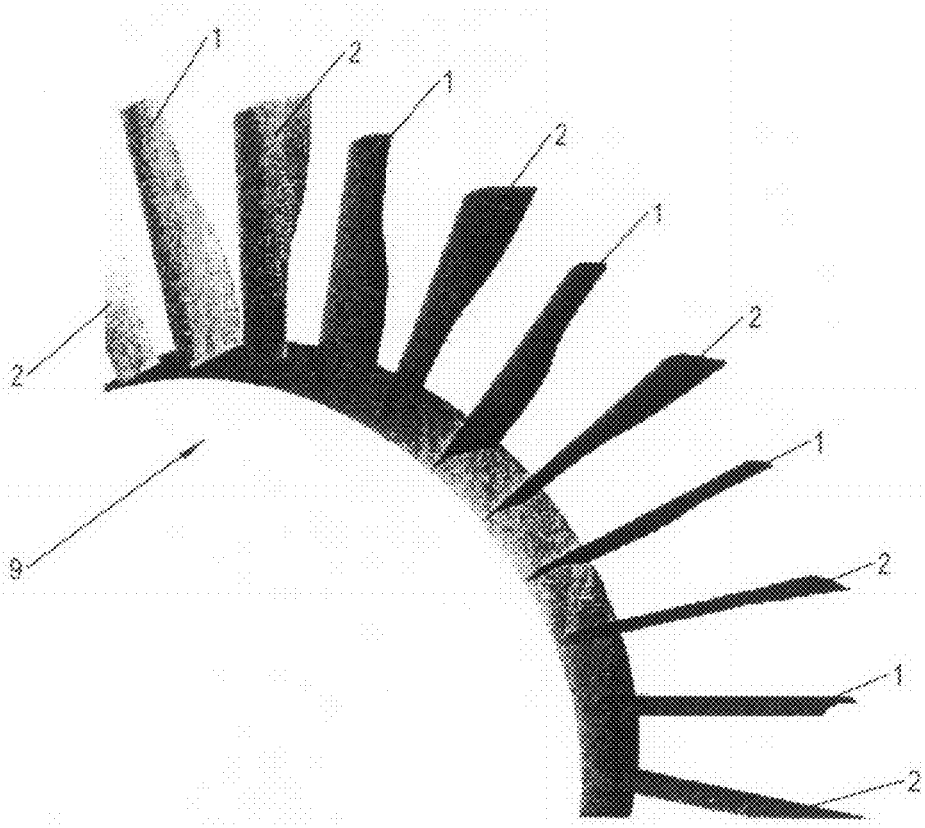

FIGS. 1 to 5 each show a schematic combined side view of a first guide vane 1 and of a second guide vane 2 of a guide vane ring of a continuous-flow machine (see FIG. 12 for example). FIGS. 1 to 5 do not show the vane roots and the vane heads of the first guide vanes 1 and of the second guide vanes 2, so that the depiction relates to the vane body or blade.

The first guide vane 1 is shown with a solid line. Each first guide vane 1 has a front edge 1*a*, a rear edge 1*b*, and a tapering 1*c*.

The second guide vane 2 is shown with a dotted line. Each second guide vane 2 has a front edge 2*a*, a rear edge 2*b*, and a tapering 2*c*.

In the combined side views, the first guide vanes 1 and the second guide vanes 2 have a shared longitudinal axis 3, which is concurrently a rotational axis. The longitudinal axes or rotational axes of the first guide vanes 1 and of the second guide vanes 2 can also be situated in different positions in the axial direction of the continuous-flow machine.

The first guide vanes 1 and the second guide vanes 2 shown in conjunction with the vane bodies define a channel height 4 with an inner area 4*a* and an outer area 4*b* in the radial direction of the continuous-flow machine. An overlapping area 4*c* is situated between the inner area 4*a* and the outer area 4*b*.

Figure 1:
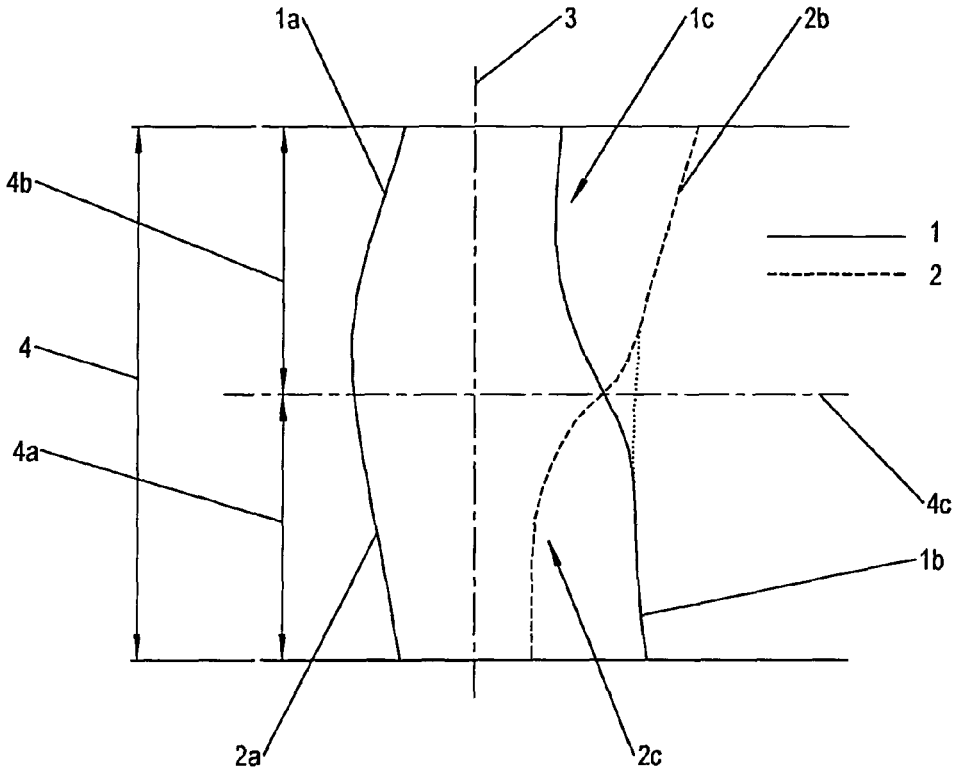
FIG. 1 a combined side view of a first guide vane and of a second guide vane of a continuous-flow machine according to the invention, in a first embodiment, FIG. 2 a combined side view of a first guide vane and of a second guide vane of a continuous-flow machine according to the invention, in a second embodiment, FIG. 3 a combined side view of a first guide vane and of a second guide vane of a continuous-flow machine according to the invention, in a third embodiment, FIG. 4 a combined side view of a first guide vane and of a second guide vane of a continuous-flow machine according to the invention, in a variant of the third embodiment, FIG. 5 a combined side view of a first guide vane and of a second guide vane of a continuous-flow machine according to the invention, in a fourth embodiment, FIGS. 6*a* to 6*c* three schematically depicted variants of a front edge or of a rear edge of a guide vane of a continuous-flow machine according to the invention, FIG. 7 a unit made up of first and second guide vanes of a continuous-flow machine according to the invention, in a first embodiment, FIG. 8 a unit made up of first and second guide vanes of a continuous-flow machine according to the invention, in a second embodiment, FIG. 9 a unit made up of first and second guide vanes of a continuous-flow machine according to the invention, in a third embodiment, FIG. 10 a unit made up of first and second guide vanes of a continuous-flow machine according to the invention, in a fourth embodiment, FIG. 11 a unit made up of first and second guide vanes of a continuous-flow machine according to the invention, in a fifth embodiment, FIG. 12 first and second guide vanes as shown in FIGS. 1, 6*c* and 7 in a continuous-flow machine according to the invention, FIG. 13 first and second guide vanes as shown in FIGS. 4, 6*c* and 7 in a continuous-flow machine according to the invention, and FIG. 14 first and second guide vanes as shown in FIGS. 4, 6*c* and 8 in a continuous-flow machine according to the invention.

In FIG. 1, the tapering 1*c* of the first guide vane 1 is situated on the rear edge 1*b* in the outer area 4*b*. The tapering 2*c* of the second guide vane 2 is situated on the rear edge 2*b* in the inner area 4*a*. The overlapping area 4*c* has a straight course.

Figure 2:
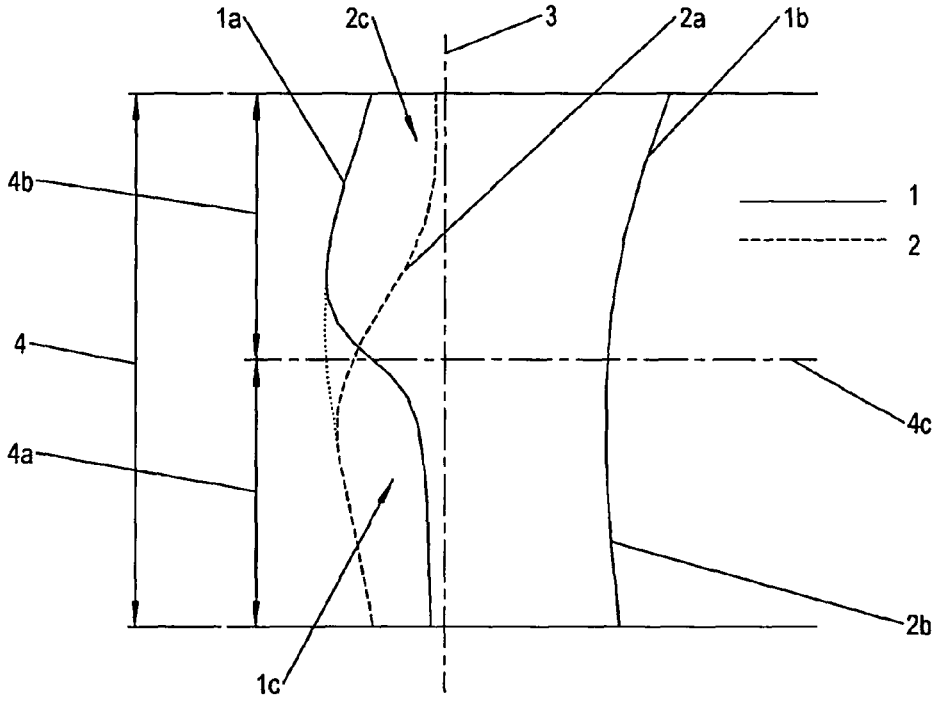

In FIG. 2, the tapering 1*c* of the first guide vane 1 is situated on the front edge 1*a* in the inner area 4*a*. The tapering 2*c* of the second guide vane 2 is situated on the front edge 2*a* in the outer area 4*b*. The overlapping area 4*c* has a straight course.

Figure 3:
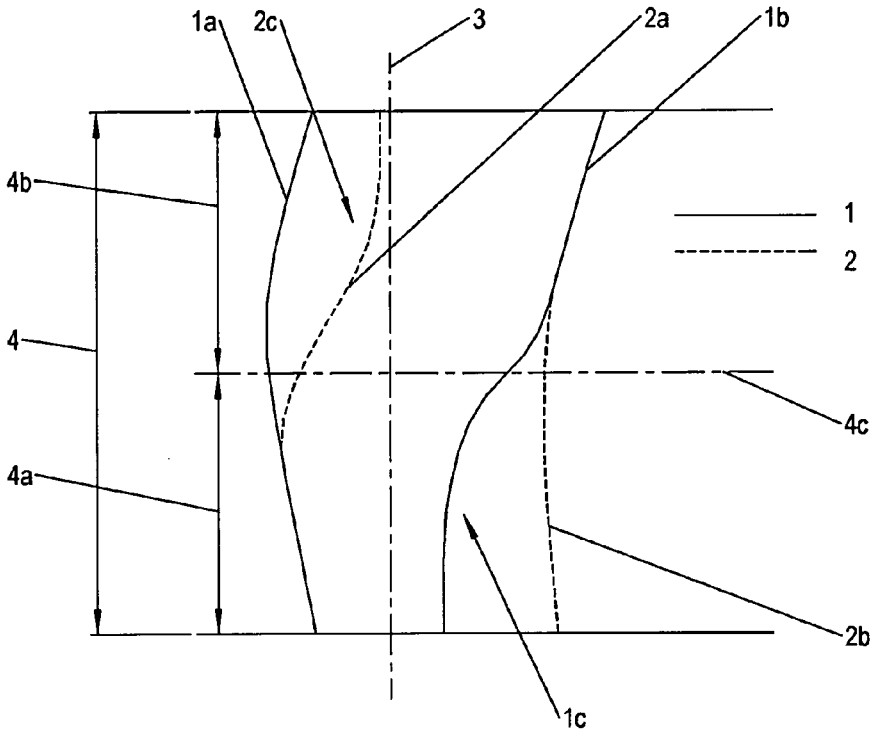

In FIG. 3, the tapering 1*c* of the first guide vane 1 is situated on the rear edge 1*b* in the inner area 4*a*. The tapering 2*c* of the second guide vane 2 is situated on the front edge 2*a* in the outer area 4*b*. The overlapping area 4*c* has a straight course.

Figure 4:
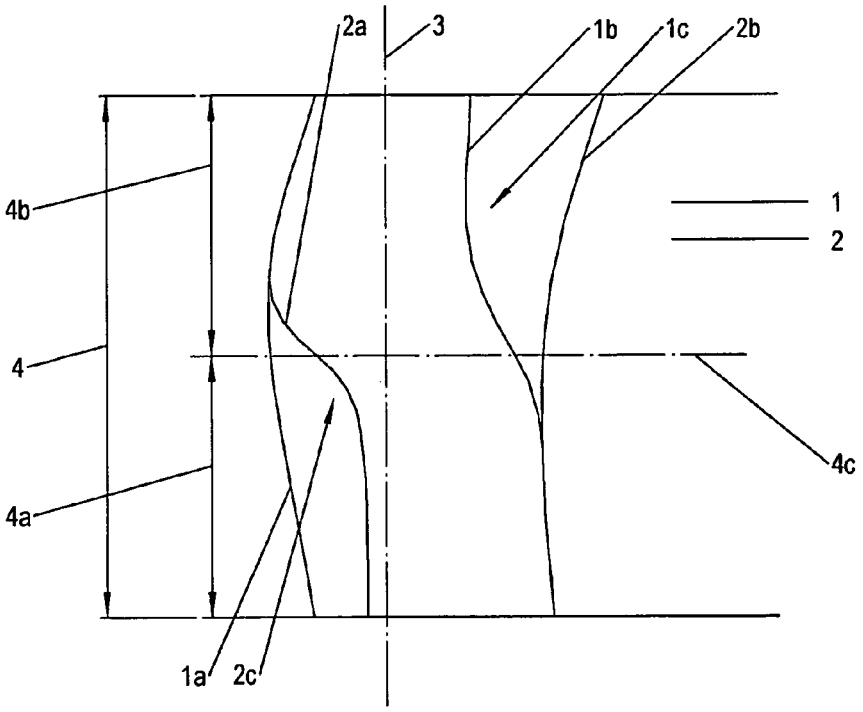

In FIG. 4, the tapering 1*c* of the first guide vane 1 is situated on the rear edge 1*b* in the outer area 4*b*. The tapering 2*c* of the second guide vane 2 is situated on the front edge 2*a* in the inner area 4*a*. The overlapping area 4*c* has a straight course.

Figure 5:
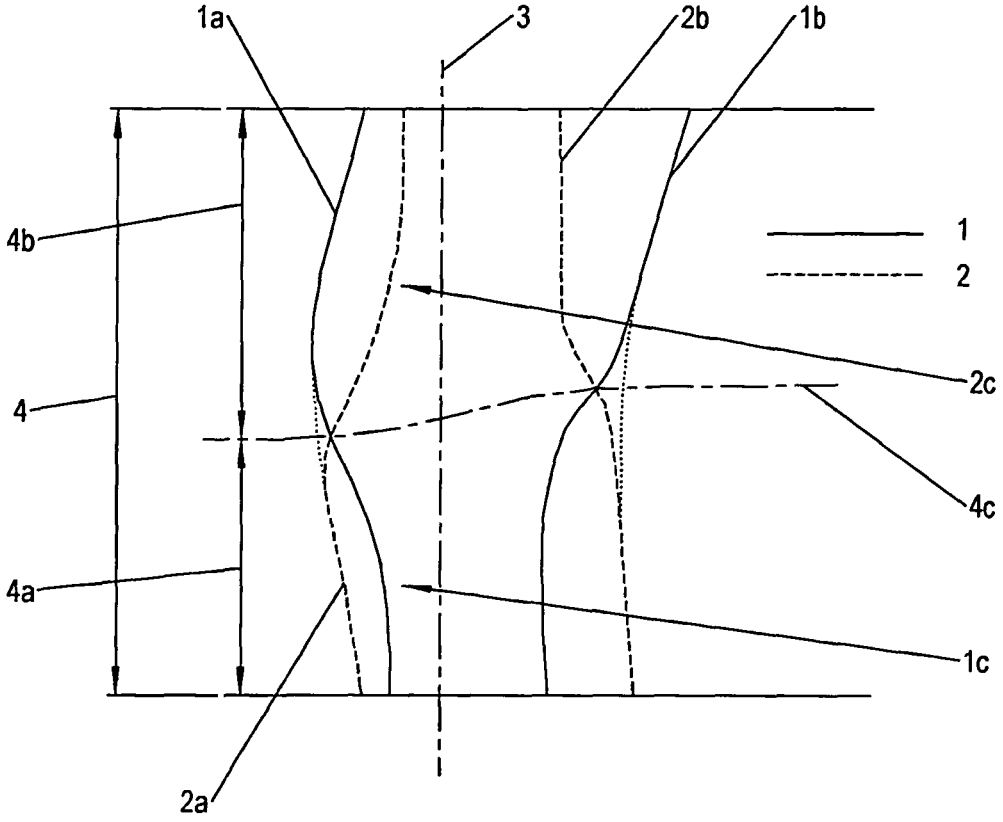

In FIG. 5, the tapering 1*c* of the first guide vane 1 is situated on the front edge 1*a* and on the rear edge 1*b* in the inner area 4*a*. The tapering 2*c* of the second guide vane 2 is situated on the front edge 2*a* and on the rear edge 2*b* in the outer area 4*b*. The overlapping area 4*c* has a straight course.

Therefore, if the tapering 1*c* of each first guide vane 1 is situated in the inner area 4*a*, the tapering 2*c* of each second guide vane 2 is always in the outer area 4*b* and vice versa.

During operation, the flow at the tapering 1*c* of each first guide vane 1 and at the tapering 2*c* of each second guide vane 2 is deflected locally to a lesser extent than where there is no tapering 1*c* on each first guide vane 1 and no tapering 2*c* on each second guide vane 2.

Figures 6A, 6B, 6C:
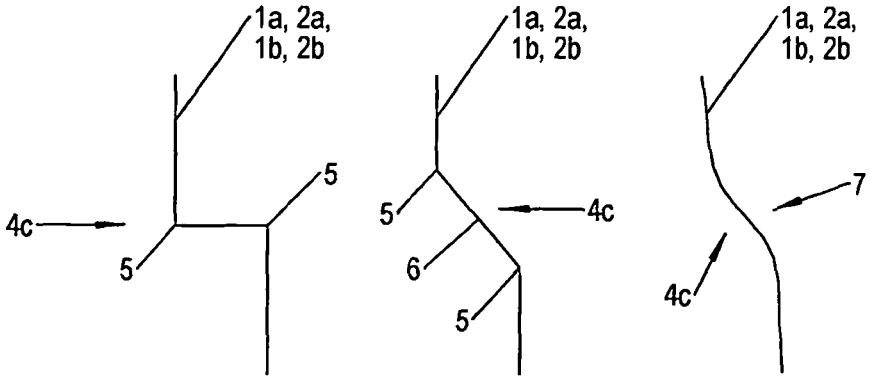

FIGS. 6*a* to 6*c* show three different examples of a front edge 1*a*, 2*a* or of a rear edge 1*b*, 2*b* of a first guide vane 1 or of a second guide vane 2 in the overlapping area 4*c*.

In FIG. 6*a*, the front edge 1*a*, 2*a* or the rear edge 1*b*, 2*b* has two stepped transitions 5. The stepped transitions 5 are configured at a right angle.

In FIG. 6*b*, the front edge 1*a*, 2*a* or the rear edge 1*b*, 2*b* has two stepped transitions 5. A slanted section 6 is situated between the stepped transitions 5.

In FIG. 6*c*, the front edge 1*a*, 2*a* or the rear edge 1*b*, 2*b* has a double curvature 6.

Figure 7:
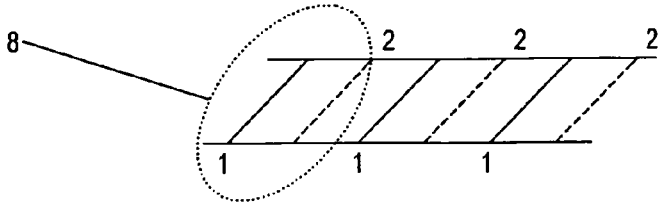
Figure 8:
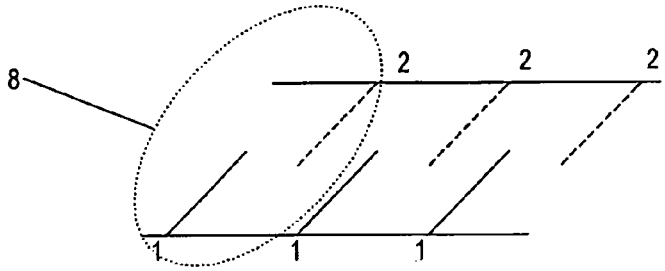
Figure 9:
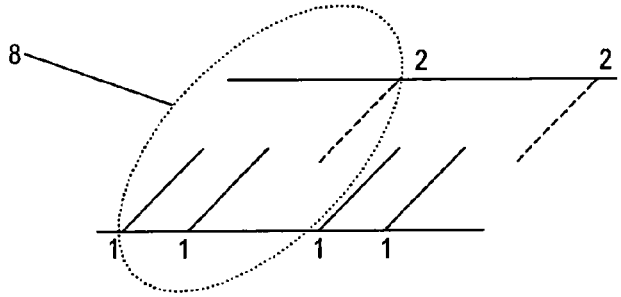

FIGS. 7 to 9 show three different schematic arrangements of first guide vanes 1 and second guide vanes 2 in a row of a guide vane ring. The arrangement is made up of units 8 in which a certain combination of first guide vanes 1 and second guide vanes 2 is defined. The units 8 are arranged along the entire inner circumference of the continuous-flow machine.

In FIG. 7, the unit 8 comprises alternatingly arranged first guide vanes 1 and second guide vanes 2 that assume the same position in the axial direction of the continuous-flow machine.

In FIG. 8, the unit 8 comprises alternately arranged first guide vanes 1 and second guide vanes 2 that are arranged offset in the axial direction of the continuous-flow machine.

In FIG. 9, the unit 8 comprises two adjacent guide vanes 1 and a second guide vane 2 that are arranged offset in the axial direction of the continuous-flow machine. By the same token, additional combinations of first guide vanes 1 with second guide vanes 2 at a ratio of, for example, 3:1 or 1:1 are possible. However, a ratio of 2:1 is preferred.

Figure 10:
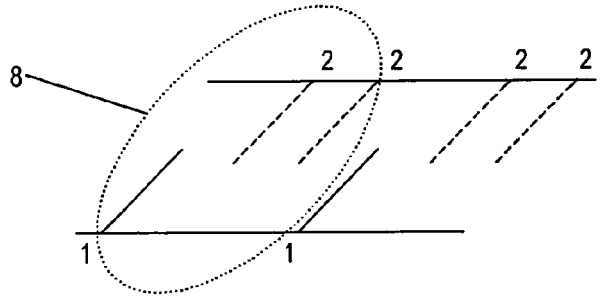

As shown in FIG. 10, a unit 8 with a "mirrored" combination is also possible. Thus, for example, FIG. 10 shows a combination of a first guide vane 1 with two second guide vanes 2. By the same token, combinations of first guide vanes 1 with second guide vanes 2 in a ratio of, for example, 1:3 are possible.

Figure 11:
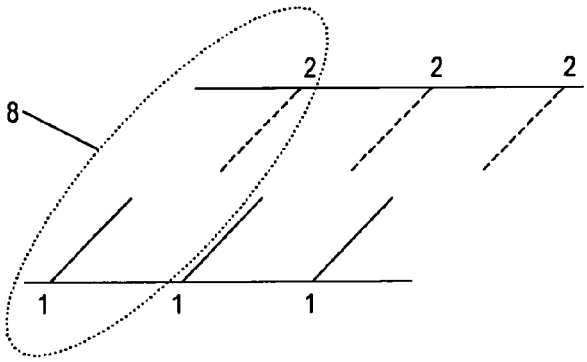

FIG. 11 shows another unit 8. In this embodiment, there is no axial overlapping between the first guide vanes 1 and the second guide vanes 2.

Figure 13:
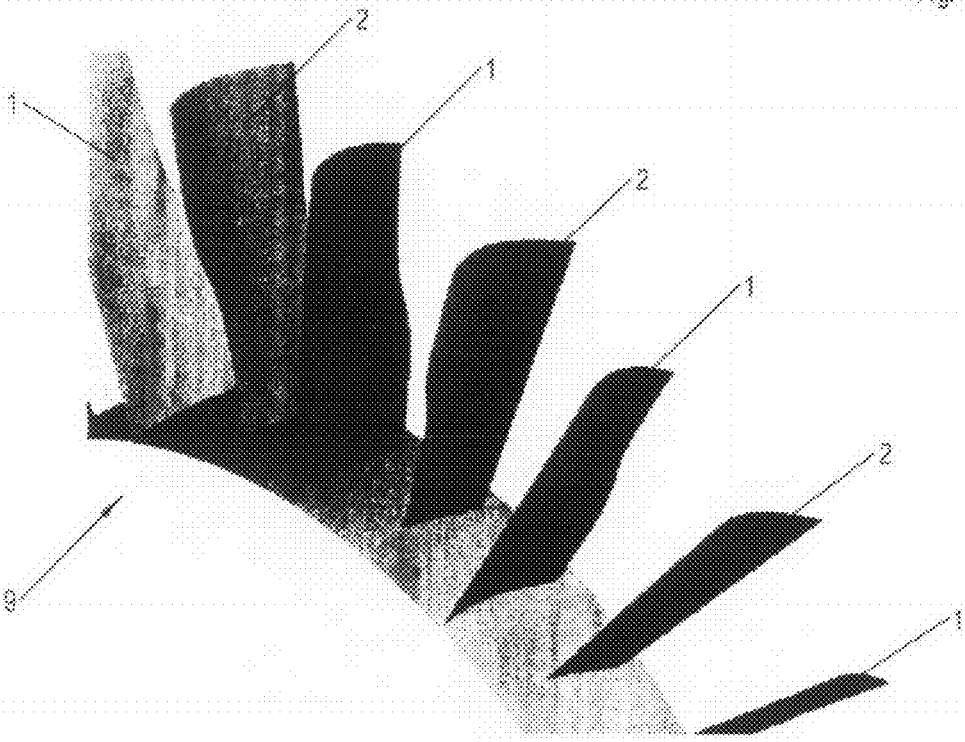
Figure 14:
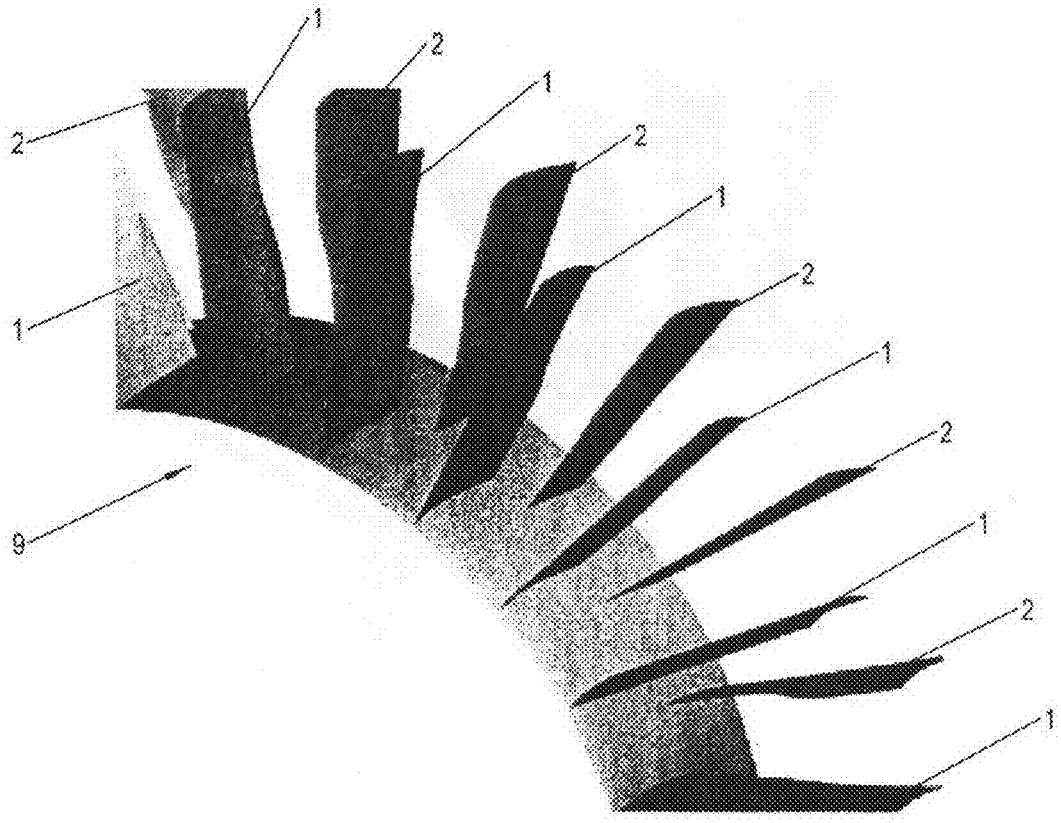

FIGS. 12 to 14 each show a perspective view of a guide vane ring 9 that is open towards the outside of the continuous-flow machine with first guide vanes 1 and second guide vanes 2.

In FIG. 12, the first guide vanes 1 and the second guide vanes 2 match those shown in FIGS. 1, 6*c* and 7.

In FIG. 13, the first guide vanes 1 and the second guide vanes 2 match those shown in FIGS. 4, 6*c* and 7.

In FIG. 14, the first guide vanes 1 and the second guide vanes 2 match those shown in FIGS. 4, 6*c* and 8.

A continuous-flow machine, especially an axial compressor, with at least one guide vane ring that comprises at least one row of adjustable guide vanes, whereby each guide vane is tapered relative to its vane body in the direction of its longitudinal axis as seen in a side view of the guide vane. In order to increase the stability of the flow in the continuous-flow machine, each row of guide vanes has first guide vanes and second guide vanes, whereby, as seen in a combined side view of a first guide vane and of a second guide vane, each first guide vane is tapered along its vane body in the lengthwise direction, and each second guide vane is tapered in the opposite direction.

LIST OF REFERENCE NUMERALS

1 first guide vane
1*a* front edge (first guide vane)
1*b* rear edge (first guide vane)
1*c* tapering (first guide vane)
2 second guide vane
2*a* front edge (second guide vane)
2*b* rear edge (second guide vane)
2*c* tapering (second guide vane)
3 longitudinal axis
4 channel height
4*a* inner area
4*b* outer area
4*c* overlapping area
5 stepped transition
6 slanted section
7 curvature
8 unit
9 guide vane ring

What is claimed is:

1. A continuous-flow machine comprising:

at least one guide vane ring, the guide vane ring defining radial, circumferential and axial directions, the guide vane ring including at least one row of a plurality of guide vanes spaced in the circumferential direction, each guide vane of the plurality of guide vanes having a vane body with a longitudinal axis in the radial direction between a base and a tip, the plurality of guide vanes including first guide vanes and second guide vanes, each first guide vane being tapered along the longitudinal axis so that the vane body becomes narrower at the tip than the base and each second guide vane being tapered in an opposite direction along the longitudinal axis so that the vane body becomes wider at the tip than the base.

2. The continuous-flow machine as recited in claim 1, wherein one of the first guide vanes and one of the second guide vanes form a unit, and a plurality of the units are evenly distributed in the circumferential direction whereby distances between adjacent one of said first and one of said second guide vanes are different from each other.

3. The continuous-flow machine as recited in claim 1 wherein the first and second guide vanes are in a same position in the axial direction of the continuous-flow machine.

4. The continuous-flow machine as recited in claim 1, wherein the second guide vanes are arranged offset in the axial direction with respect to the first guide vanes.

5. The continuous-flow machine as recited in claim 1 wherein the first guide vanes and the second guide vanes have an overlapping area in the axial direction.

6. The continuous-flow machine as recited in claim 1, wherein each of the first guide vanes taper due to a varying shape of rear edge of the first guide vane and each of the second guide vanes taper due to a further varying shape of the second guide vane.

7. The continuous-flow machine as recited in claim 1, wherein each of the first guide vanes taper due to a varying shape of front edge of the first guide vane and each of the second guide vanes taper due to a further varying shape of the second guide vane.

8. The continuous-flow machine as recited in claim 1, wherein each of the first guide vanes tapers due to a varying shape of rear edge of the first guide vanes and each of the second guide vanes tapers due to a further varying shape of front edge of the second guide vane of appertaining second guide vane.

9. The continuous-flow machine as recited in claim 1, wherein each of the first guide vanes tapers due to a varying shape of both a first guide vane rear edge and front edge and each of the second guide vanes tapers due to a varying shape of both a second guide vane rear edge and front edge.

10. The continuous-flow machine as recited in claim 1 wherein an edge of one of the first and second guide vanes is both convex and concave with respect to the vane body.

11. The continuous-flow machine as recited in claim 1, wherein an edge of one of the first and the second guide vanes has a stepped contour having at least two stepped transitions.

12. The continuous-flow machine as recited in claim 1, wherein the taper of each of the first guide vanes amounts to 30% to 70% of the maximum width of each second guide vane, or the taper of each of the second guide vanes amounts to 30% to 70% of the maximum width of each of the first guide vanes.

13. The continuous-flow machine as recited in claim 1 wherein the first guide vanes and the second guide vanes that are each in the same position along the longitudinal axis have different curvatures of their blade skeleton lines or different profile mean lines.

14. The continuous flow machine according to claim 1, wherein in the radial direction each of the first and the second guide vanes has an inner tapering deflecting a flow outwardly, and an outer tapering deflecting a flow inwardly to provide stability of a flow in the continuous-flow machine.

15. The continuous-flow machine as recited in claim 1, wherein one of the first guide vanes and one of the second guide vanes form a unit, and a plurality of the units are evenly distributed in the circumferential direction whereby distances between adjacent one of said first and one of said second guide vanes are equal to each other.

16. The continuous-flow machine as recited in claim 2 wherein three of the guide vanes form the unit.

17. The continuous-flow machine as recited in claim 5 wherein the overlapping area is located in an area of 30% to 70% of a channel height defined by a length of the vane body along the longitudinal axis.

18. The continuous-flow machine as recited in claim 13 wherein the first guide vanes and the second guide vanes each have the different curvatures of the skeleton lines or the different profile mean lines in an outer area and in an inner area in the radial direction.

19. An axial compressor comprising a continuous-flow machine, the continuous flow machine further including:

at least one guide vane ring, the guide vane ring defining radial, circumferential and axial directions, the guide vane ring including at least one row of a plurality of guide vanes spaced in the circumferential direction, each guide vane of the plurality of guide vanes having a vane body with a longitudinal axis in the radial direction between a base and a tip, the plurality of guide vanes including first guide vanes and second guide vanes, each first guide vane being tapered along the longitudinal axis so that the vane body becomes narrower at the tip than the base and each second guide vane being tapered in an opposite direction along the longitudinal axis so that the vane body becomes wider at the tip than the base.

* * * * *